US006460633B1

(12) United States Patent
Driver

(10) Patent No.: US 6,460,633 B1
(45) Date of Patent: Oct. 8, 2002

(54) SIDE TRACKING BIT

(76) Inventor: W. B. Driver, P.O. Box 1281, Greenville, TX (US) 75403

( * ) Notice: Subject to any disclaimer, the term of this patent is extended or adjusted under 35 U.S.C. 154(b) by 0 days.

(21) Appl. No.: 09/559,612

(22) Filed: Apr. 27, 2000

(51) Int. Cl.[7] ..... E21B 7/08
(52) U.S. Cl. ..... 175/73; 175/256
(58) Field of Search ..... 175/61, 73, 89, 175/90, 256, 76

(56) References Cited

U.S. PATENT DOCUMENTS 2,167,194 A * 7/1939 Anderson
2,266,383 A * 12/1941 Quintrell
2,291,100 A * 7/1942 Oswald
2,402,238 A * 6/1946 Carpenter
3,131,778 A * 5/1964 Emerson et al.
3,667,556 A * 6/1972 Henderson ..... 175/73
5,727,641 A * 3/1998 Eddison et al. ..... 175/76

* cited by examiner

*Primary Examiner*—William Neuder

(57) ABSTRACT

In the invention a side tracking bit that has a flexible interface between the bit crown and the bit shank which greatly reduces the length of inflexible structure between the face of the bit and the flexible interface. The limiting of the length of inflexible structure between the face of the bit and the flexible point significantly increases the side tracking bit's angle in starting and drilling a curved hole from the vertical to the horizontal and significantly shorten the radius of the curved hole.

1 Claim, 2 Drawing Sheets

SIDE TRACKING BIT

CROSS REFERENCE TO RELATED APPLICATIONS

I have no other applications related to this application.

FEDERAL FUNDING

There was no federal funding or other support provided in the design and development of this invention.

MICROFICHE APPENDIX REQUIREMENT

Microfiche was not required in this specification

BACKGROUND OF THE INVENTION

The following is a description of the background of the invention;

(1) Field of the Invention

The field of invention pertains to the equipment required to conduct the drilling of high angle well holes or the curved holes from the vertical to the horizontal to a point where a horizontal drain hole can be drilled into an oil or gas formation. This invention is primarily directed toward the drilling of the curved hole. The curved hole, drilled from a vertical well hole is generally classified by its radius of curvature since it represents a fourth of a circle. The curved hole is classified as long radius, short radius and ultra short radius. The long radius is usually several hundred feet. The short radius is usually around a hundred feet and the ultra short radius is usually around 30 feet. This invention is aimed at providing curved holes with ultra short radii of 4 to 8 feet which can be drilled with flexible motors as shown in my U.S. Pat. No. 4,227,584. Also the design of the invention can be constructed small enough to provide small diameter curved holes of 1.5 to 2 inches with radii of 25 to 36 inches. The invention could be operated with a small diameter flexible drill pipe, as show in my U.S. Pat. No. 4,233,820, to drill the small diameter curved holes.

(2) Description of Related Art

The related art is the tools that actually direct the drilling of the curved hole from the vertical to the horizontal. In the older days the most successful means of accomplishing this type of drilling was to use a knuckle joint connected to the drill bit with a short sub. Presently the primarily approach is to use a bit connect by a bent sub containing a bent driving mechanism to a short down hole motor. The knuckle joint was used with standard drill pipe and could hardly drill long radius curved holes. The short down hole motor with the bent sub can drill what is presently called ultra short radius, which is limited to around a 30-foot radius. This limitation of around 30 feet is because of the bent sub limits and the length of the motor. Also another limiting factor is the distance from the face of the drill bit and the flex point of the knuckle joint and the bent sub. Also bent subs can not be used with flexible drill pipe and the structure of the bent subs and knuckle joints limits the diameter of the curved hole they can drill to several inches.

SUMMARY OF THE INVENTION

One of the limiting factors in drilling an ultra short radius curved hole is the length of the inflexible section on each of a flexible joint. It is an objective of this invention to keep the inflexible section between the flexible joint and the face of the bit as short as possible so the face of the bit has maximum directional capability when it is interface with the wall a vertical well hole.

One of the objectives of the invention is to provide a design that can maximize the diameter of the shank of the bit in relation to the diameter of the hole being drilled to enhance the torque carrying capability of the shank.

It is an objective of the invention to provide a design that can be constructed for drilling large curved holes of several inches in diameter or constructed to drill small curved holes of one to two inches in diameter.

An objective of the invention is to provide a flexible point on the backside of the face of the crown of the bit.

An objective of the invention is to provide the capability for the crown of the bit to flex equal distance in opposite directions.

It is an objective of the invention to provide a side tracking bit that has a flexible section between the crown of the bit and the shank of the bit.

It is an objective of the invention to provide a side tracking bit that can be rotated while the crown is titled at an angle to the shank of the bit.

It is an objective of the invention to provide a side tracking bit that can drill a curved hole from the vertical to the horizontal with an ultra short radius.

It is an objective of the invention to provide a side tracking bit that can be readily disassembled for repairs An objective of the invention is to provide a means of locking a plurality of studs inside a shank of a bit, that are drilled around the same circumference, with minimum obstruction to drilling fluids being pumped though the shank.

An objective of the invention is to provide a side tracking bit when drilling into the wall of a vertical well hole can minimize the distance it has to drill to have an associated flexible joint also through the wall of the vertical well hole.

Figure 1:
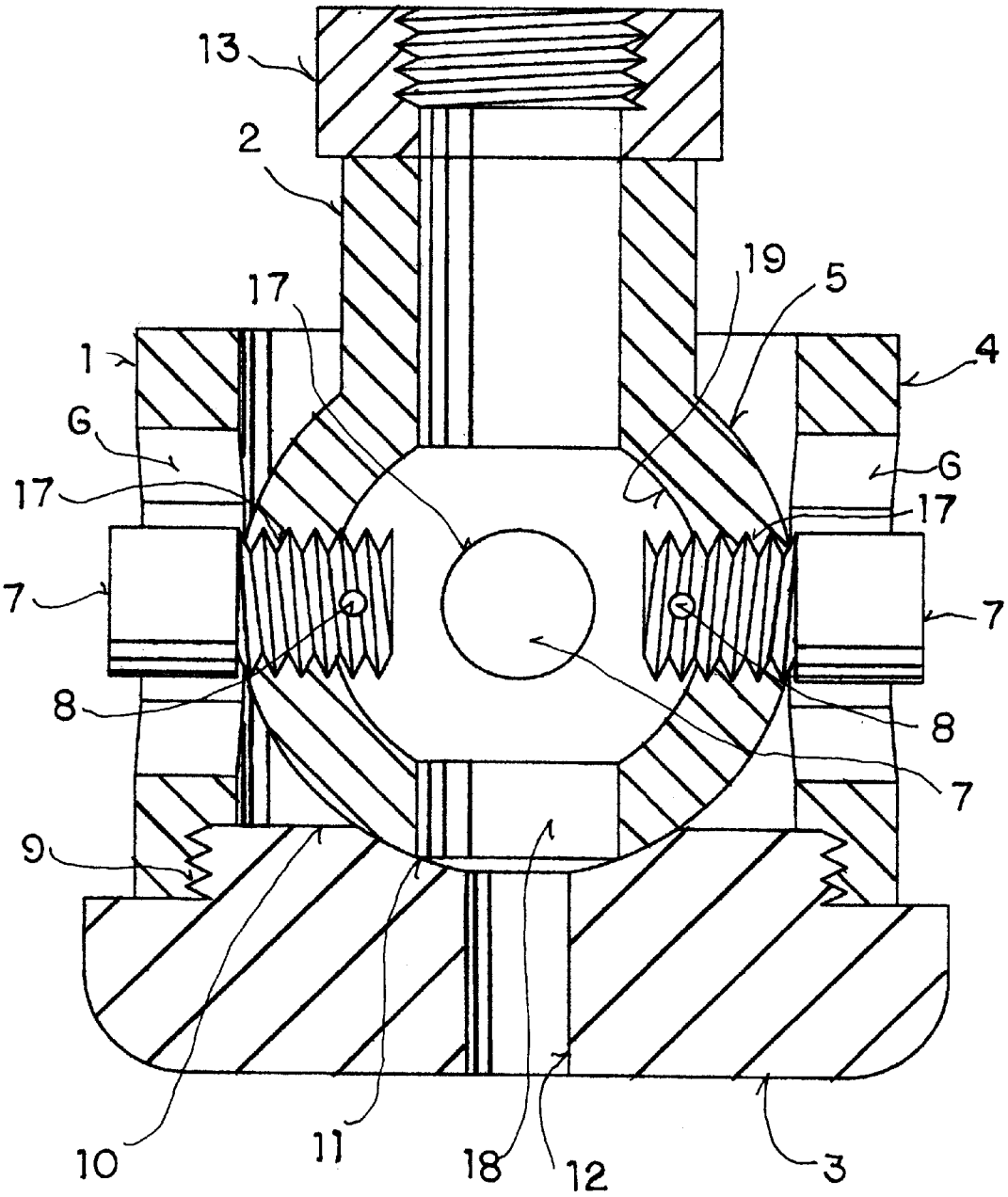
FIG. 1 illustrates a cross section of the side tracking bit: Show is how the different elements of the sidetracking bit are assembled in the construction of the sidetracking bit. For clarity the O-ring is not shown.

REFERENCE NUMERALS IN THE DRAWINGS:

1. side tracking bit
2. bit shank
3. bit crown
4. connecting tube
5. spherical knob
6. slot
7. stud
8. pinhole
9. internal threads
10. threaded extension
11. concave cavity
12. exhaust port
13. tool joint

14. O-ring
15. square rim
16. concave curved rim
17. threaded hole
18. flow port
19. Internal wall

DESCRIPTION OF THE PREFERRED EMBODIMENT

Figure 3:
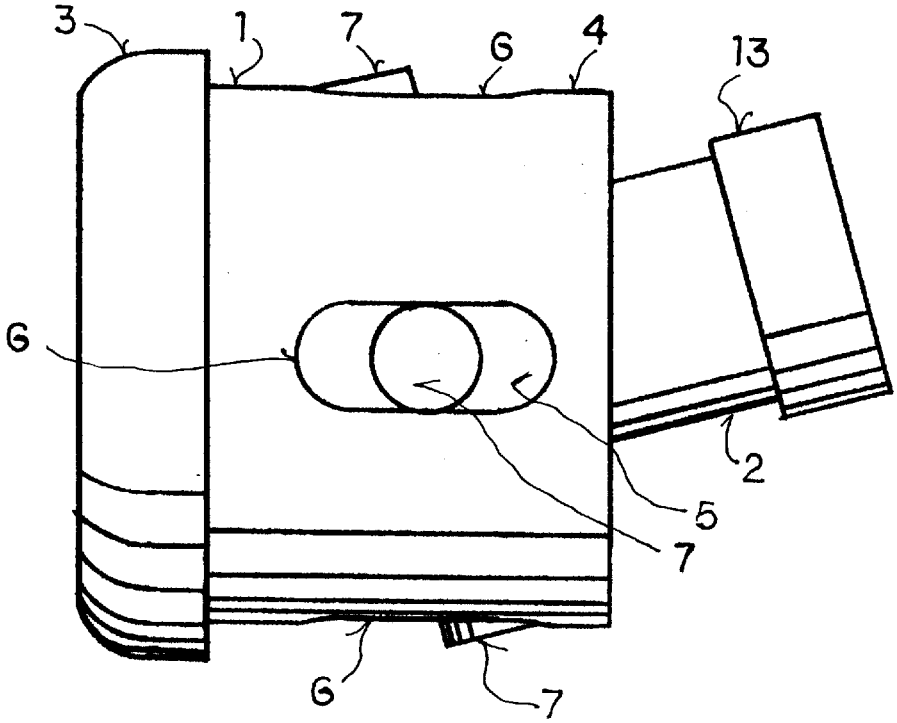
FIG. 3 Illustrates a side view of the side tracking bit: This figure shows the side tracking bit in a flexed position where the plane of the bit crown is not perpendicular to the axle center of the bit shank.

A side tracking bit 1, See FIG. 1 and FIG. 3, comprising a bit shank 2 which is a straight tube with a spherical knob 5 on one end the bit shank 2. The spherical knob 5 has a larger diameter than the straight part of the bit shank 2. Flow port 18 has the same axle center and diameter as the internal diameter of the straight part of bit shank 2 and lets drilling flow through bit shank 2. The internal wall 19 of the spherical knob 5 is spherical concave and has larger internal diameter than the internal diameter of the straight part of the bit shank 2. The radius of the internal wall 19 of the spherical knob 5 has the same center as the outside surface of the spherical knob 5. Four threaded holes 17 are through the wall of the spherical knob 5 equally spaced around the circumference of the spherical knob 5 and perpendicular to and at maximum distance form the axle center of the shank 2. The overall diameter of the spherical knob 5 is large enough to slip inside of connecting tube 4 and touch the inside wall of the connecting tube 4. Connecting tube 4 has four slots 6 though the wall of connecting tube 4 and the length of the slots 6 are parallel to the axle center of connecting tube 4. The end of connecting tube 4 that interfaces with bit crown 3 has internal threads 9. See FIG. 1. On the backside of bit crown 3 is a threaded extension 10 that can screw into the internal threads 9 of connecting tube 4. The center part of the surface of the thread extension 10 has a concave cavity 11 which can fit spherical knob 5. An exhaust port 12 is through the axle center of the bit crown 3 so drilling fluids can flow over and cool the face of bit crown 3 and remove cuttings.

Figure 2:
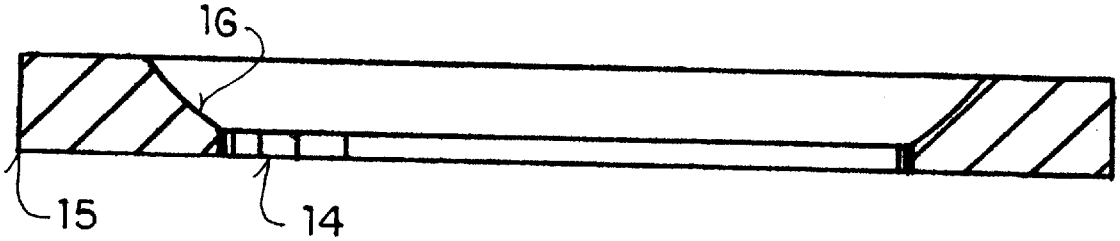
FIG. 2 Illustrates a cross section of the O-ring: Shown is the geometric shape of the O-ring so it can fit with the corner formed by the interface of the inside wall of the connecting tube and the threaded extension and the surface of the spherical knob on the end of the bit shank.

Studs 7 have threads on one end and a pinhole 8 through the studs 7 near the end of the thread end of studs 7. The width of the slots 6 are wide enough for the studs 7 to slip through the slots 6 and still touch the sides of the slots 6. The studs 7 screw into the threaded holes 17 and the reads on threaded end of studs 7 are long enough for the pinhole 8 to extend pass the inside wall of spherical knob 5 so a retaining pin can be put through pinhole 8. This will keep the studs 7 from unscrewing during operations of the side tracking bit 1. The internal wall 19 is concave so studs 7 can extend through internal wall 19 enough for a pin or other locking device be put through pen hole 8 and not obstruct drilling fluids pumped through bit shank 2. Tool joint 13 is connected to the straight end of the shank 2 extending form the connecting tube 4 see FIG. 1 and FIG. 3. The tool joint 13 provides a means for drill pipe or other tools to be attached to side tracking bit 1. O-ring 14 has an outside square rim 15 that fit around the interface of the threaded extension 10 and the inside wall of the connecting tube 4. See FIG. 2. A concave curved corner 16 diagonal from the square rim 15 interfaces with the spherical knob 5. 0ring 14 restricts flow by of drilling fluids so most of the drilling fluids will go through the exhaust port 12.

The side tracking bit 1 is assembled by placing the spherical knob 5 of shank 2 in connecting tube 4 and aligning the slots 6 with the threaded holes 17. The studs 7 are screwed into the threaded holes 17 through the slots 6 and a retaining pin is put through the pinholes 8. O-ring 14 is pressed into the end of connecting tube 4 having the internal threads 9 so the concave curved rim 16 will interfaced with spherical knob 5, then connecting tube 4 internal threads 9 are screwed over the thread extension 10 connecting the connecting tube 4 to the bit crown 3. Torque from the shank 2 is transmitted to the connecting tube 4 through the studs 7. The spherical knob s seats in the concave cavity 11 in the center of the threaded extension 10 and from a pivot or flex point. The connecting tube 4 with its slots 6 and the studs 7 with the spherical knob 5 forms a universal joint between the shank 2 and the bit crown 3. When the bit crown 3 is directed from a deflector or whip stock against a vertical well hole wall it will try to align greater angle of deflection than present methods. This increased angle of deflection of bit crown 3 will the capability to drill curved holes from the vertical to the horizontal with a more shorten radius than present methods.

I claim:

1. A side tracking bit providing a flex point, a bit crown of said bit, a face of said bit crown, a bit shank, said flex point being between said bit crown and said bit shank providing a much shorter length than other methods from said face of said bit crown and said flex point that greatly increases the pivotal capability of said bit crown more than other methods when said bit interfaces with the wall of a well hole and greatly increases the side tracking capability of said bit, said bit comprising said bit shank constructed with a straight tubular section with a spherical knob constructed on one end of said tubular section of said bit shank, said spherical knob being larger in diameter than said tubular section, said spherical knob having a concave spherical shaped internal wall with the radius center of said internal wall being the same position as the radius center of said spherical knob, said internal wall having a diameter larger than the internal diameter of said tubular section, a flow port through the wall of said spherical knob, said flow port having the same diameter and axial center as said tubular section of said bit shank, four threaded holes through the wall of said spherical knob and equally spaced around the circumference of said spherical knob and perpendicular to and at maximum distance from the axial center of said tubular section of said bit shank, a connecting tube, four slots through the wall of said connecting tube, said four slots equally spaced around the circumference of said connecting tube, the length of said slots being parallel to the axial center of said connecting tube, one internal end portion of said connecting tube having internal threads, said diameter of said spherical knob is small enough to slip inside of said connecting tube and be in contact with the internal wall of said connecting tube to limit vibration when said bit is in operation, four studs, said studs having one end portion threaded and a pinhole through said studs near the threaded end of said studs, the width of said slots is wide enough for said studs to slip through and still be in contact with the sides of said slots, said studs are screwed into said threaded holes in said spherical knob through said slots, thread end of said studs is long enough for said pinhole to be passed through the internal wall of said spherical knob so a retaining pin can be placed in said pin-hole, a threaded extension on the backside of said bit crown, the center of said threaded extension having a concave cavity, said cavity having a radius the same as the radius of said spherical knob, said spherical knob and said cavity interface and form said flex point of said bit, said flex point provides a pivotal point for said bit crown, an exhaust port through the axial center of said bit crown, said threaded extension being large enough to screw into said internal threads of said connecting tube connecting said connecting tube to said bit crown, a geometric shaped o-ring, the outside rim of said o-ring fits into the corner formed by the interface of the inside wall of said connecting tube and the top of said threaded extension, said o-ring have a internal rim concave curved to interface with said spherical knob, a tool joint connected to the end of said tubular section of said bit shank that extends form said connecting tube.

* * * * *